US011427916B2

(12) United States Patent
Mikawa et al.

(10) Patent No.: US 11,427,916 B2
(45) Date of Patent: Aug. 30, 2022

(54) SURFACE TREATMENT APPARATUS AND SURFACE TREATMENT METHOD

(71) Applicant: MITSUBISHI HEAVY INDUSTRIES, LTD., Tokyo (JP)

(72) Inventors: Hiroaki Mikawa, Tokyo (JP); Hiromitsu Nagayasu, Tokyo (JP); Shigehiro Sugiyama, Tokyo (JP); Takumi Sato, Tokyo (JP); Kohei Kawasaki, Tokyo (JP); Yusuke Takagi, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 531 days.

(21) Appl. No.: 16/338,050

(22) PCT Filed: Jun. 12, 2017

(86) PCT No.: PCT/JP2017/021627
§ 371 (c)(1),
(2) Date: Mar. 29, 2019

(87) PCT Pub. No.: WO2018/066175
PCT Pub. Date: Apr. 12, 2018

(65) Prior Publication Data

US 2019/0233944 A1 Aug. 1, 2019

(30) Foreign Application Priority Data

Oct. 6, 2016 (JP) ..... JP2016-197785

(51) Int. Cl.
*C23C 22/48* (2006.01)
*B05D 1/02* (2006.01)
(Continued)

(52) U.S. Cl.
CPC ..... *C23C 22/76* (2013.01); *B05D 1/02* (2013.01); *B05D 3/00* (2013.01); *B05D 7/14* (2013.01);
(Continued)

(58) Field of Classification Search
USPC ..... 148/243
See application file for complete search history.

(56) References Cited

U.S. PATENT DOCUMENTS 6,090,254 A 7/2000 Sobata et al.
2001/0042491 A1 11/2001 Shimakura et al.
(Continued)

FOREIGN PATENT DOCUMENTS

CN 202849543 U 4/2013
CN 204174277 U 2/2015
(Continued)

OTHER PUBLICATIONS

International Search Report and Written Opinion for International Application No. PCT/JP2017/021627 dated Jul. 18, 2017; 11pp.
(Continued)

*Primary Examiner* — Lois L Zheng
(74) *Attorney, Agent, or Firm* — Hauptman Ham, LLP

(57) ABSTRACT

A surface treatment apparatus includes a treatment vessel including a treatment space in which a metal component is disposed, a spray nozzle that supplies mist of a non-chromate conversion treatment liquid to the treatment space, and a circulation device that collects the non-chromate conversion treatment liquid from the treatment space and supplies the non-chromate conversion treatment liquid to the spray nozzle.

8 Claims, 10 Drawing Sheets

(51) Int. Cl.

| | |
|---|---|
| ***C23C 22/76*** | (2006.01) |
| ***C23C 22/78*** | (2006.01) |
| ***C23C 22/77*** | (2006.01) |
| ***B05D 3/00*** | (2006.01) |
| ***B05D 7/14*** | (2006.01) |
| *B05D 3/10* | (2006.01) |
| *C23F 11/00* | (2006.01) |

(52) U.S. Cl.
CPC ..... *C23C 22/77* (2013.01); *C23C 22/78* (2013.01); *C23C 2222/20* (2013.01)

(56) References Cited

U.S. PATENT DOCUMENTS

| | | | | |
|---|---|---|---|---|
| 2004/0007249 | A1* | 1/2004 | Kishi | C23C 22/00 134/2 |
| 2008/0305358 | A1* | 12/2008 | Rudolph | C23C 22/83 428/688 |
| 2011/0048454 | A1 | 3/2011 | Saeki et al. | |
| 2012/0094231 | A1 | 4/2012 | Norikane et al. | |
| 2016/0158785 | A1 | 6/2016 | Zhou et al. | |

FOREIGN PATENT DOCUMENTS

| | | | |
|---|---|---|---|
| CN | 104391433 | A | 3/2015 |
| EP | 1550823 | A1 | 7/2005 |
| JP | H09253573 | A | 9/1997 |
| JP | H11217698 | A | 8/1999 |
| JP | 2001316845 | A | 11/2001 |
| JP | 2006225714 | A | 8/2006 |
| JP | 2009293062 | A | 12/2009 |
| JP | 2014031556 | A | 2/2014 |
| JP | 5888583 | B2 | 3/2016 |

OTHER PUBLICATIONS

Partial Search Report for European Application No. 17858015.5 dated Sep. 19, 2019; 18pp.
Extended European Search Report for European Application No. 17858015.5 dated Jan. 17, 2020; 16pp.
Office Action for Chinese Application No. 201780060703.5 dated Sep. 21, 2020; 16pp.

* cited by examiner

SURFACE TREATMENT APPARATUS AND SURFACE TREATMENT METHOD

RELATED APPLICATIONS

The present application is a National Phase of International Application Number PCT/JP2017/021627 filed Jun. 12, 2017 and claims priority to Japanese Application Number 2016-197785 filed Oct. 6, 2016.

FIELD

The present invention relates to a surface treatment apparatus and a surface treatment method.

BACKGROUND

One of known surface treatment methods for metal components is a chromate conversion treatment. The chromate conversion treatment refers to a method for performing surface treatment on a component made of metal such as iron, zinc, magnesium, or aluminum with the use of a chromate conversion treatment liquid mainly containing chromic acid. Meanwhile, in consideration of harm of chromium on the environment and human bodies, the use of the chromate conversion treatment liquid has come to be restricted. In view of this, a non-chromate conversion treatment, in which the surface treatment is performed on the metal component with a non-chromate conversion treatment liquid not containing chromic acid, has recently attracted attention.

Examples of the non-chromate conversion treatment liquid that have been developed include many kinds of non-chromate conversion treatment liquids such as inorganic, organic, and mixed non-chromate conversion treatment liquids. Examples of the inorganic non-chromate conversion treatment liquid include Zr, Ti, Mo, W, Mn, Co, and Ce based non-chromate conversion treatment liquids. Examples of the organic non-chromate conversion treatment liquid include a non-chromate conversion treatment liquid including a silane coupling agent (see Patent Literature 1 and Patent Literature 2).

Known examples of a method for applying the treatment liquid to the metal component include an immersion method in which the metal component is immersed in the treatment liquid, a spraying method in which the metal component is sprayed with the treatment liquid from a spray gun, a brush coating method in which the treatment liquid is applied on the metal component using a brush, and a mist deposit method in which a treatment space is filled with the mist of the treatment liquid so that the treatment liquid is applied to the metal component (see Patent Literature 3).

CITATION LIST

Patent Literature

Patent Literature 1: Japanese Patent Application Laid-open No. 2001-316845

Patent Literature 2: Japanese Patent Application Laid-open No. 2014-031556

Patent Literature 3: U.S. Pat. No. 5,888,583

SUMMARY

Technical Problem

The non-chromate conversion treatment liquid is more expensive than the chromate conversion treatment liquid. In addition, the non-chromate conversion treatment liquid has a shorter pot life and is usable only for a limited time. In the case of applying the non-chromate conversion treatment liquid, which is expensive and has a shorter pot life, on the metal component in accordance with the immersion method, the treatment liquid is used in large quantity; therefore, the cost is very high. In the case of applying the treatment liquid on the metal component in accordance with the spraying method, a larger quantity of treatment liquid is wasted without adhering on the metal surface. In the spraying method, more steps are required to apply the treatment liquid on the metal components. In the case of applying the treatment liquid on the metal in accordance with the brush coating method, it is difficult to apply the treatment liquid to the metal components at the same time and the treatment efficiency is low. In the mist deposit method as disclosed in Patent Literature 3, the mist of the treatment liquid is not circulated, so that the liquid is consumed more. In addition, inert gas is required to make the mist of the treatment liquid adhere on the surface of the metal component; in this case, it costs to install the facility and maintain and manage the facility.

The present invention has an object to provide a surface treatment apparatus and a surface treatment method that are capable of performing surface treatment on a metal component with various shapes with less non-chromate conversion treatment liquid, and that are capable of performing surface treatment on metal components at the same time.

Solution to Problem

The present invention provides a surface treatment apparatus including a treatment vessel, a single-fluid spray nozzle, and a circulation device. The treatment vessel includes a treatment space in which a metal component is disposed. The single-fluid spray nozzle supplies mist of a non-chromate conversion treatment liquid with an average droplet diameter of 70 [μm] or less to the treatment space. The circulation device collects the non-chromate conversion treatment liquid from the treatment space and supplies the non-chromate conversion treatment liquid to the spray nozzle.

In the surface treatment apparatus according to the present invention, preferably, an amount of non-chromate conversion treatment liquid that is held and circulates in a treatment liquid circulation system is 10 [L] or less per cubic meter [$m^3$] of the treatment space. The treatment liquid circulation system includes the spray nozzle, the treatment vessel, and the circulation device.

In the surface treatment apparatus according to the present invention, preferably, an amount of non-chromate conversion treatment liquid to be supplied from the spray nozzle to the treatment space is 10 [L/min] or less per cubic meter [$m^3$] of the treatment space.

In the surface treatment apparatus according to the present invention, preferably, a mist concentration of the non-chromate conversion treatment liquid in the treatment space is 100 [mL] or more and 5000 [mL] or less per cubic meter [$m^3$] of the treatment space.

In the surface treatment apparatus according to the present invention, preferably, the circulation device includes a temperature control device that controls a temperature of the non-chromate conversion treatment liquid.

Preferably, the surface treatment apparatus according to the present invention further includes a detector that detects a mist concentration of the non-chromate conversion treatment liquid in the treatment space, and an amount of non-chromate conversion treatment liquid to be supplied from the spray nozzle is controlled based on a detection result from the detector.

Preferably, the surface treatment apparatus according to the present invention further includes a suppressing device that suppresses leak of the non-chromate conversion treatment liquid from an opening provided at an upper part of the treatment vessel.

In the surface treatment apparatus according to the present invention, preferably, the suppressing device includes an opening/closing device. The opening/closing device includes a lid member capable of closing the opening, and a switching mechanism capable of switching between an open state and a closed state of the lid member.

Preferably, the surface treatment apparatus according to the present invention further includes a conveyance device that conveys the metal component into and from the treatment space through the opening.

Preferably, the surface treatment apparatus according to the present invention further includes a cleaning liquid supply device, and a waste liquid recovery device. The cleaning liquid supply device supplies a cleaning liquid for cleaning inside of the treatment vessel and inside of the circulation device when the non-chromate conversion treatment liquid is exchanged. The waste liquid recovery device collects a waste liquid including at least one of the non-chromate conversion treatment liquid and the cleaning liquid.

A surface treatment method according to the present invention includes performing a mist spraying treatment for supplying mist of a non-chromate conversion treatment liquid from a spray nozzle to a treatment space of a treatment vessel in which a metal component is disposed; and supplying, from the spray nozzle to the treatment space, the non-chromate conversion treatment liquid collected from the treatment space.

Preferably, the surface treatment method according to the present invention further includes performing a degreasing treatment and an oxide film removing treatment for the metal component before the mist spraying treatment. The metal component is sequentially conveyed by a conveyance device into a degreasing vessel in which the degreasing treatment is performed, a deoxidizing treatment vessel in which the oxide film removing treatment is performed, and the treatment vessel in which the mist spraying treatment is performed.

Advantageous Effects of Invention

According to the present invention, there can be provided a surface treatment apparatus and a surface treatment method that are capable of performing surface treatment on a metal component with various shapes with less non-chromate conversion treatment liquid, and that are capable of performing surface treatment on metal components at the same time.

DESCRIPTION OF EMBODIMENTS

An embodiment according to the present invention will be described in detail below with reference to the drawings; however, the present invention is not limited to the embodiment. The elements in the embodiment to be described below can be combined as appropriate. Some elements may be omitted.

In the description below, an XYZ rectangular coordinate system is set, and with reference to this XYZ rectangular coordinate system, the positional relation of the parts is described. A direction in a horizontal plane is an X-axis direction, a direction that is orthogonal to the X-axis direction in the horizontal plane is a Y-axis direction, and a vertical direction is a Z-axis direction.

[Surface Treatment Apparatus]

Figure 1:
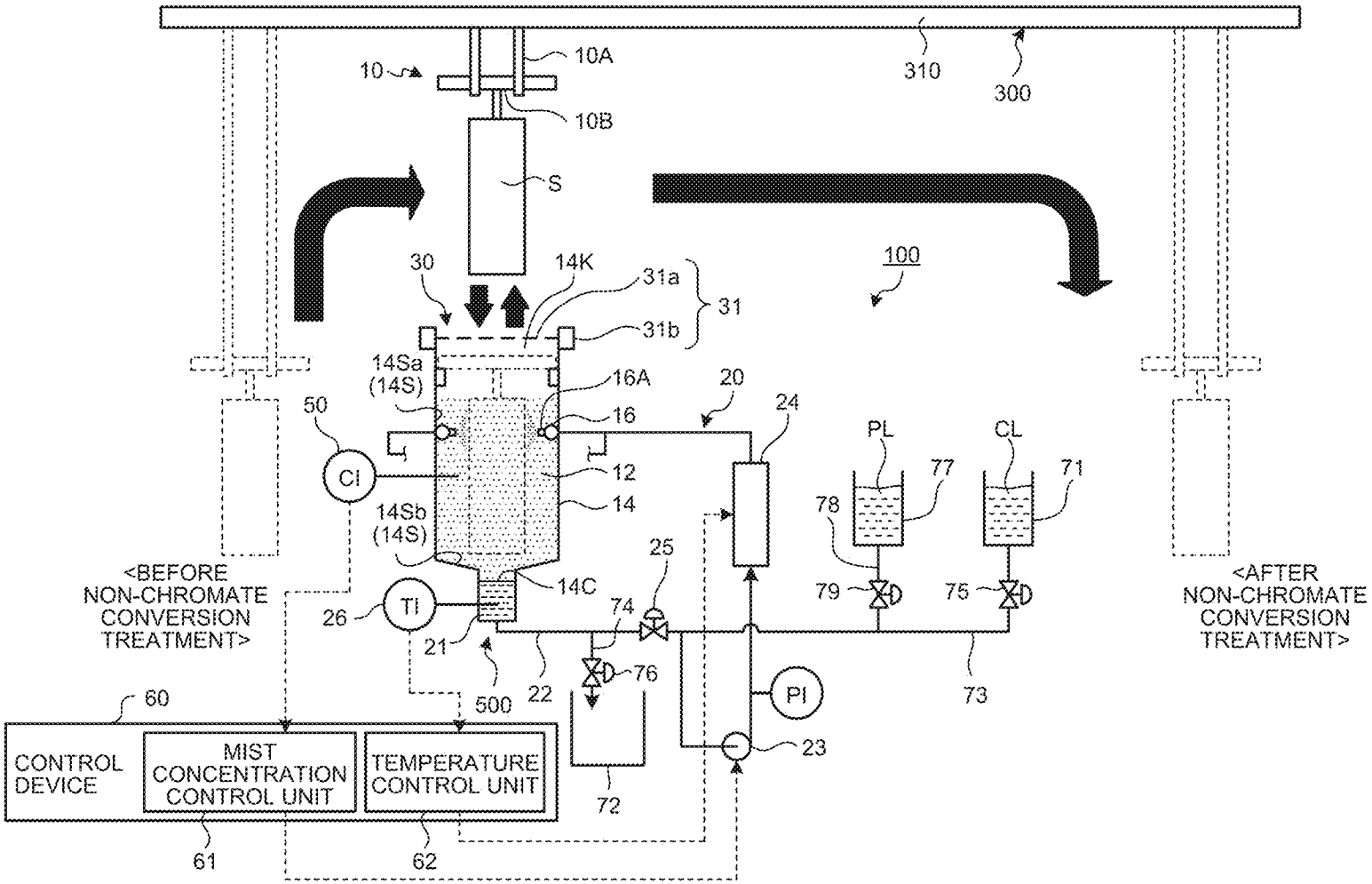
FIG. 1 is a schematic diagram illustrating one example of a surface treatment apparatus according to one embodiment.

FIG. 1 is a front view schematically illustrating one example of a surface treatment apparatus 100 according to the present embodiment.

As illustrated in FIG. 1, a surface treatment apparatus 100 includes: a holding mechanism 10 including a rack (not illustrated) or the like to hold a metal component S that is placed thereon; a treatment vessel 14 including a treatment space 12 in which the metal component S is disposed; a spray nozzle 16 that supplies mist of a non-chromate conversion treatment liquid PL to the treatment space 12 in the treatment vessel 14; and a circulation device 20 that collects the non-chromate conversion treatment liquid PL from the treatment space 12 in the treatment vessel 14 and supplies the non-chromate conversion treatment liquid PL to the spray nozzle 16.

The surface treatment apparatus 100 further includes: a suppressing device 30 that suppresses leak of the non-chromate conversion treatment liquid PL from an opening 14K provided at an upper part of the treatment vessel 14; a detector 50 that detects the concentration of the mist of the non-chromate conversion treatment liquid PL in the treatment space 12; and a control device 60 that controls the surface treatment apparatus 100.

The surface treatment apparatus 100 performs a non-chromate conversion treatment on the metal component S by the use of the non-chromate conversion treatment liquid PL. The non-chromate conversion treatment is a chemical conversion treatment that causes the non-chromate conversion treatment liquid PL not containing chromium to perform a chemical reaction on a surface of the metal component S, so that the surface of the metal component S has a property different from that of the material of the metal component S.

The metal component S is a member with a surface of metal such as iron, zinc, magnesium, aluminum, stainless steel, or titanium. The metal component S may be formed of at least one of a cold-rolled steel sheet, a hot-rolled steel sheet, a stainless steel sheet, an electrogalvanized steel sheet, a galvanized steel sheet, a zinc-aluminum alloy plated steel sheet, a zinc-iron alloy plated steel sheet, a zinc-magnesium alloy plated steel sheet, a zinc-aluminum-magnesium alloy plated steel sheet, an aluminum based plated steel sheet, an aluminum-silicon alloy plated steel sheet, a tin based plated steel sheet, a lead-tin alloy plated steel sheet, a chromium based plated steel sheet, and a nickel based plated steel sheet.

The metal component S after the non-chromate conversion treatment is usable for a structure such as an aircraft.

The non-chromate conversion treatment liquid PL is prepared by mixing a plurality of kinds of chemicals and has a pot life. In the present embodiment, the non-chromate conversion treatment liquid PL is a treatment liquid mainly containing a silane compound. The non-chromate conversion treatment liquid PL includes a silane coupling agent, and forms an organic film on the metal component S. The non-chromate conversion treatment liquid PL may include, for example, two or more kinds of silane coupling agents; a silane coupling agent, water-dispersible silica, and zirconium or titanium ions; a silane coupling agent having a particular functional group that reacts with aqueous emulsion; or aqueous emulsion, a compound in which two molecules of β-diketone and two molecules of water are coordinated with a trivalent transition metal ion, and a silane coupling agent.

The silane coupling agent, when being brought into contact with water, forms a silanol group through hydrolysis. The silanol group is polymerized through self-condensation and chemically bonds with an OH group on the surface of the metal with an acid-base reaction; thus, the stabilized coating substrate is obtained. In addition, the silanol group is firmly bonded to a coating component through chemical bonding or crosslinking, so that the good adhesion is achieved.

In the case of preparing the non-chromate conversion treatment liquid PL by mixing the chemicals, the silane coupling agent is polymerized gradually as time passes after the chemicals are mixed. Once the non-chromate conversion treatment liquid PL is polymerized, it becomes difficult to apply the liquid to the surface of the metal compound S in the favorable manner. In view of this, a time period during which the non-chromate conversion treatment liquid PL can be used is set, and this time period is referred to as pot life. In the present embodiment, the surface treatment apparatus 100 applies the non-chromate conversion treatment liquid PL before the end of the pot life is applied to the surface of the metal component S. The surface treatment apparatus 100 needs to exchange the non-chromate conversion treatment liquid when the pot-life has passed. In this case, cleaning is performed before the exchange.

Figure 2:
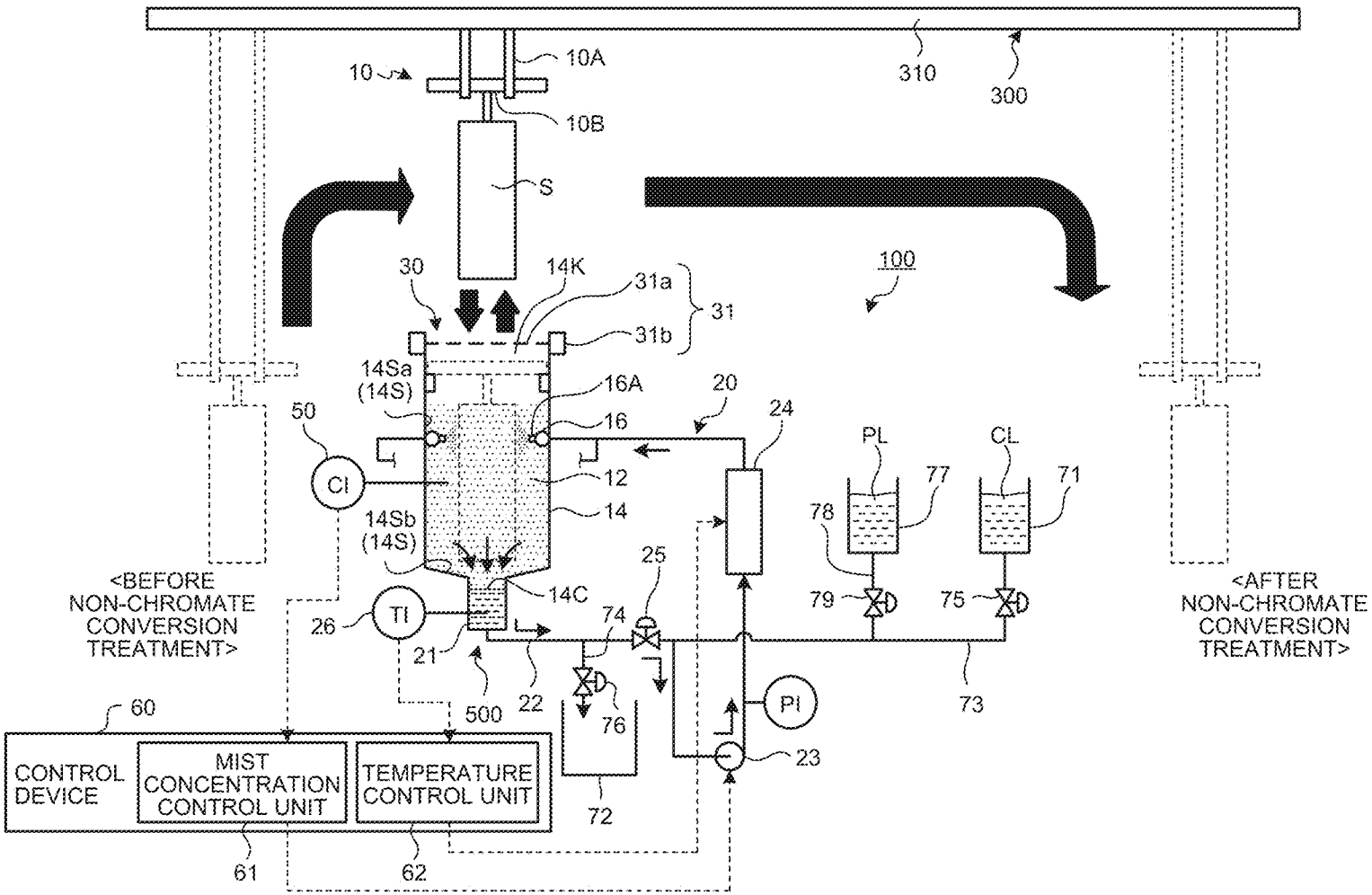
FIG. 2 is a schematic diagram illustrating one example of the surface treatment apparatus according to one embodiment.

The holding mechanism 10 includes a suspension member 10A that is connected to a part of the metal component S, and a support member 10B that supports the suspension member 10A. The holding mechanism 10 holds the metal component S so that the metal component S is placed in the treatment space 12. As illustrated in FIG. 2, in the present embodiment, more than one metal component S is disposed in the treatment space 12.

The opening 14K is provided at the upper part of the treatment vessel 14. The holding mechanism 10 can carry the metal component S into and out of the treatment space 12 through the opening 14K.

The treatment vessel 14 has an inner surface 14S that faces the treatment space 12. The treatment space 12 is an inner space of the treatment vessel 14. The inner surface 14S has an inner side surface 14Sa and a bottom surface 14Sb that surround the treatment space 12. The holding mechanism 10 holds the metal component S so that the metal component S is not brought into contact with the inner surface 14S of the treatment vessel 14.

At a lower part of the treatment vessel 14, a collecting port 14C is provided. The bottom surface 14Sb is inclined downward to the collecting port 14C.

The spray nozzle 16 is disposed in the treatment space 12, and supplies the mist of the non-chromate conversion treatment liquid PL to the treatment space 12. In the treatment space 12, the spray nozzle 16 and the metal component S are disposed in the X-axis direction and/or the Y-axis direction. More than one spray nozzle 16 is disposed in the treatment space 12.

The spray nozzle 16 includes an injection orifice 16A from which the mist of the non-chromate conversion treatment liquid PL is injected to a central part of the treatment space 12. The injection orifice 16A and the metal component S are preferably apart from each other by 150 mm or more.

The spray nozzle 16 is a single-fluid spray nozzle. That is to say, the spray nozzle 16 injects only the compressed non-chromate conversion treatment liquid PL from the injection orifice 16A without mixing the non-chromate conversion treatment liquid PL and compressed air. Thus, the treatment space 12 has an atmosphere of the mist of the non-chromate conversion treatment liquid PL.

In the present embodiment, the average droplet diameter of the mist of the non-chromate conversion treatment liquid PL that is supplied from the spray nozzle 16 to the treatment space 12 is 70 [μm] or less. Note that the average droplet diameter of the mist of the non-chromate conversion treatment liquid PL is preferably 10 [μm] or more and 40 [μm] or less.

The spray nozzle 16 injects the non-chromate conversion treatment liquid PL so that the mist concentration of the non-chromate conversion treatment liquid PL in the treatment space 12 becomes sufficiently high and uniform. The mist concentration refers to the amount (ratio) of the mist of the non-chromate conversion treatment liquid PL existing per unit volume of the treatment space 12. The control device 60 regulates the flow rate of the mist of the non-chromate conversion treatment liquid PL that is injected from the injection orifice 16A of the spray nozzle 16 so that the mist concentration in the treatment space 12 becomes uniform.

In order to make the treatment space 12 have sufficiently high and uniform mist concentration, the number of spray nozzles 16, the relative position thereof, and the direction of the injection orifice 16A in the treatment space 12 can be adjusted. In addition, in order to make the treatment space 12 have sufficiently high and uniform mist concentration, the distance between the spray nozzle 16 and the metal component S can be adjusted.

The control device 60 regulates the amount of non-chromate conversion treatment liquid PL to be supplied from the spray nozzle 16 to the treatment space 12 per unit time on the basis of the size (capacity) of the treatment space 12. In the present embodiment, the amount of non-chromate conversion treatment liquid PL that is supplied from the spray nozzle 16 to the treatment space 12 is 10 [L/min] or less per cubic meter [$m^3$] of the treatment space 12, preferably 0.5 [L/min] or more and 2.0 [L/min] or less per cubic meter [$m^3$] of the treatment space 12.

In order to apply the non-chromate conversion treatment liquid PL sufficiently on the surfaces of the metal component S, the mist concentration of the non-chromate conversion treatment liquid PL in the treatment space 12 is preferably high. In the present embodiment, the mist concentration of the non-chromate conversion treatment liquid PL in the treatment space 12 is 100 [mL] or more and 5000 [mL] or less per cubic meter [$m^3$] of the treatment space 12.

The treatment space 12 is filled with the mist of the non-chromate conversion treatment liquid PL supplied from the spray nozzle 16. The average droplet diameter of the mist is sufficiently small, and the mist drifts slowly in the treatment space 12. The mist drifting in the treatment space 12 adheres not just on the surface of the metal component S that faces the spray nozzle 16 but also on the surface of the metal component S that does not face the spray nozzle 16. That is to say, the mist injected from the spray nozzle 16 diffuses throughout the treatment vessel 14; therefore, the mist goes round to reach the back side of the metal component S, which does not face the spray nozzle 16, and adheres to the surface of the metal component S on the back side. In addition, the mist adheres uniformly on the surfaces of the metal component S regardless of the shape of the metal component S. In the case in which the metal components S are disposed in the treatment space 12, the mist adheres uniformly to the surfaces of each metal component S.

The circulation device 20 includes: a collecting pit 21 that collects the non-chromate conversion treatment liquid PL from the treatment space 12; a pipe 22 that connects between the collecting pit 21 and the spray nozzle 16; a pump 23 that is provided to the pipe 22; a temperature control device 24 that controls the temperature of the non-chromate conversion treatment liquid PL; and a thermometer 26 that measures the temperature of the non-chromate conversion treatment liquid PL.

The mist of the non-chromate conversion treatment liquid PL that fills the treatment space 12 falls spontaneously by the action of gravity, and thus moves to the bottom surface 14Sb. The non-chromate conversion treatment liquid PL having moved to the bottom surface 14Sb moves along the inclined bottom surface 14Sb and is collected at the collecting port 14C. The non-chromate conversion treatment liquid PL collected at the collecting port 14C flows into the collecting pit 21 through the collecting port 14C. The collecting pit 21 holds the collected non-chromate conversion treatment liquid PL.

The pump 23 sends with pressure the non-chromate conversion treatment liquid PL collected at the collecting pit 21 to the spray nozzle 16. By the operation of the pump 23, the non-chromate conversion treatment liquid PL at the collecting pit 21 flows in a flow channel of the pipe 22 and after the pressure thereof is increased by the pump 23, the non-chromate conversion treatment liquid PL is supplied to the spray nozzle 16. The spray nozzle 16 makes the non-chromate conversion treatment liquid PL, whose pressure has been increased by the pump 23, into the mist and supplies the mist to the treatment space 12.

In the present embodiment, the amount of non-chromate conversion treatment liquid PL that is supplied from the spray nozzle 16 to the treatment space 12 per unit time is substantially equal to the amount of non-chromate conversion treatment liquid PL that is collected from the treatment space 12 to the collecting pit 21 per unit time.

The temperature control device 24 is provided to the pipe 22 between the pump 23 and the spray nozzle 16 and controls the temperature of the non-chromate conversion treatment liquid PL that is supplied to the spray nozzle 16. If the temperature of the non-chromate conversion treatment liquid PL (indication value of the thermometer 26) has increased excessively, at least some of the non-chromate conversion treatment liquid PL is vaporized and the property of the non-chromate conversion treatment liquid PL changes. For example, in a case in which the non-chromate conversion treatment liquid PL contains alcohol, such excessive increase in temperature causes more non-chromate conversion treatment liquid PL to vaporize. Moreover, if the temperature of the non-chromate conversion treatment liquid PL has increased excessively, the pot life of the non-chromate conversion treatment liquid PL may become shorter. The temperature control device 24 controls the temperature of the non-chromate conversion treatment liquid PL so that the property of the non-chromate conversion treatment liquid PL changes less. The temperature control device 24 controls the temperature of the non-chromate conversion treatment liquid PL so that the non-chromate conversion treatment liquid PL has a proper temperature.

The suppressing device 30 includes an opening/closing device 31 that can switch between opening and closing of the opening 14K of the treatment vessel 14. The opening/closing device 31 includes a lid member 31*a* that can close the opening 14K, and a switching mechanism 31*b* that can switch between an open state and a closed state of the lid member 31*a*. In a state in which the opening/closing device 31 opens the opening 14K (open state), the metal component S can be conveyed into and from the treatment space 12 through the opening 14K. In a state in which the opening/closing device 31 closes the opening 14K (closed state), the leak of the mist of the non-chromate conversion treatment liquid PL, which fills the treatment space 12, out of the treatment space 12 through the opening 14K can be suppressed.

In the present embodiment, the suppressing device 30 makes the opening/closing device 31 open, and after a conveyance device 300 conveys the metal component S into the treatment space 12 through the opening 14K, makes the opening/closing device 31 closed. Next, the pump 23 operates to make the non-chromate conversion treatment liquid PL adhere on the surfaces of the metal component S and then, the pump 23 stops. Subsequently, the suppressing device 30 makes the opening/closing device 31 open. After that, the conveyance device 300 conveys the metal component S from the treatment space 12 through the opening 14K.

The detector 50 is disposed at an upper part of the treatment space 12 and detects the mist concentration of the non-chromate conversion treatment liquid PL in the treatment space 12. The detector 50 emits detection light to the treatment space 12 in the treatment vessel 14 and detects the transmissivity or scattering degree of the detection light, thereby detecting the mist concentration in the treatment space 12. A detection result of the detector 50 is output to the control device 60.

The control device 60 includes a mist concentration control unit 61 and a temperature control unit 62. The mist concentration control unit 61 controls the pump 23 on the basis of the detection result from the detector 50, thereby regulating the amount of non-chromate conversion treatment liquid PL that is supplied from the spray nozzle 16 to the treatment space 12 per unit time. The control device 60 monitors whether the mist concentration in the treatment space 12 has a proper value on the basis of the detection result from the detector 50, and regulates the amount of non-chromate conversion treatment liquid PL that is supplied from the spray nozzle 16 to the treatment space 12 as necessary. In addition, the temperature control unit 62 controls the temperature control operation of the temperature control device 24 on the basis of the detection result from the thermometer 26.

In the present embodiment, the circulation device 20 causes the non-chromate conversion treatment liquid PL to circulate in a treatment liquid circulation system 500 including the spray nozzle 16, the treatment vessel 14, and the circulation device 20. The flow channel of the treatment liquid circulation system 500 includes an inner flow channel of the spray nozzle 16, the treatment space 12 in the treatment vessel 14, the storage space of the collecting pit 21 of the circulation device 20, and the flow channel of the pipe 22. In the case of circulating the non-chromate conversion treatment liquid PL in the treatment liquid circulation system 500, a valve 25 provided to the pipe 22 is opened.

In the present embodiment, the amount of non-chromate conversion treatment liquid PL that is held and flows in the treatment liquid circulation system 500 is 10 [L] or less per cubic meter [$m^3$] of the treatment space 12. The amount of non-chromate conversion treatment liquid PL that is held corresponds to the amount of non-chromate conversion treatment liquid PL consumed in the surface treatment apparatus 100. Since the pot life is limited as described above, it is necessary to exchange the non-chromate conversion treatment liquid PL. For this reason, the amount of non-chromate conversion treatment liquid PL that is held and flows in the treatment liquid circulation system 500 is preferably small from the viewpoint of reducing the consumption of non-chromate conversion treatment liquid PL.

[Cleaning Device]

As illustrated in FIG. 1, the surface treatment apparatus 100 includes: a cleaning liquid supply device 71 that supplies a cleaning liquid CL that cleans the inside of the treatment vessel 14 and the inside of the circulation device 20 when the non-chromate conversion treatment liquid PL is exchanged; and a waste liquid recovery device 72 that collects a waste liquid including at least one of the non-chromate conversion treatment liquid PL whose pot life has expired and the cleaning liquid CL that has been used in the cleaning.

One example of the cleaning liquid CL is hot water. The hot water has a temperature of, for example, 60 [° C.] or more. The cleaning liquid supply device 71 includes a cleaning liquid tank that stores the cleaning liquid CL. The waste liquid recovery device 72 includes a waste liquid tank that stores the waste liquid. The cleaning liquid supply device 71 is connected to the pipe 22 of the circulation device 20 through a pipe 73. The waste liquid recovery device 72 is connected to the pipe 22 of the circulation device 20 through a pipe 74.

As illustrated in FIG. 1, the surface treatment apparatus 100 includes an exchange treatment liquid supply device 77 that supplies a new liquid of the non-chromate conversion treatment liquid PL to be exchanged. The exchange treatment liquid supply device 77 includes a treatment liquid tank that stores the non-chromate conversion treatment liquid PL. The exchange treatment liquid supply device 77 is connected to the pipe 22 of the circulation device 20 through the pipe 78 and the pipe 73.

FIG. 2 illustrates a state in which the non-chromate conversion treatment liquid PL circulates in the treatment liquid circulation system 500 and the non-chromate conversion treatment is performed. In the non-chromate conversion treatment, in the state in which the metal component S is disposed in the treatment vessel 14, the valve 25 provided to the pipe 22 is opened and the valve 75 provided to the pipe 73 and the valve 76 provided to the pipe 74 are closed.

Figure 3:
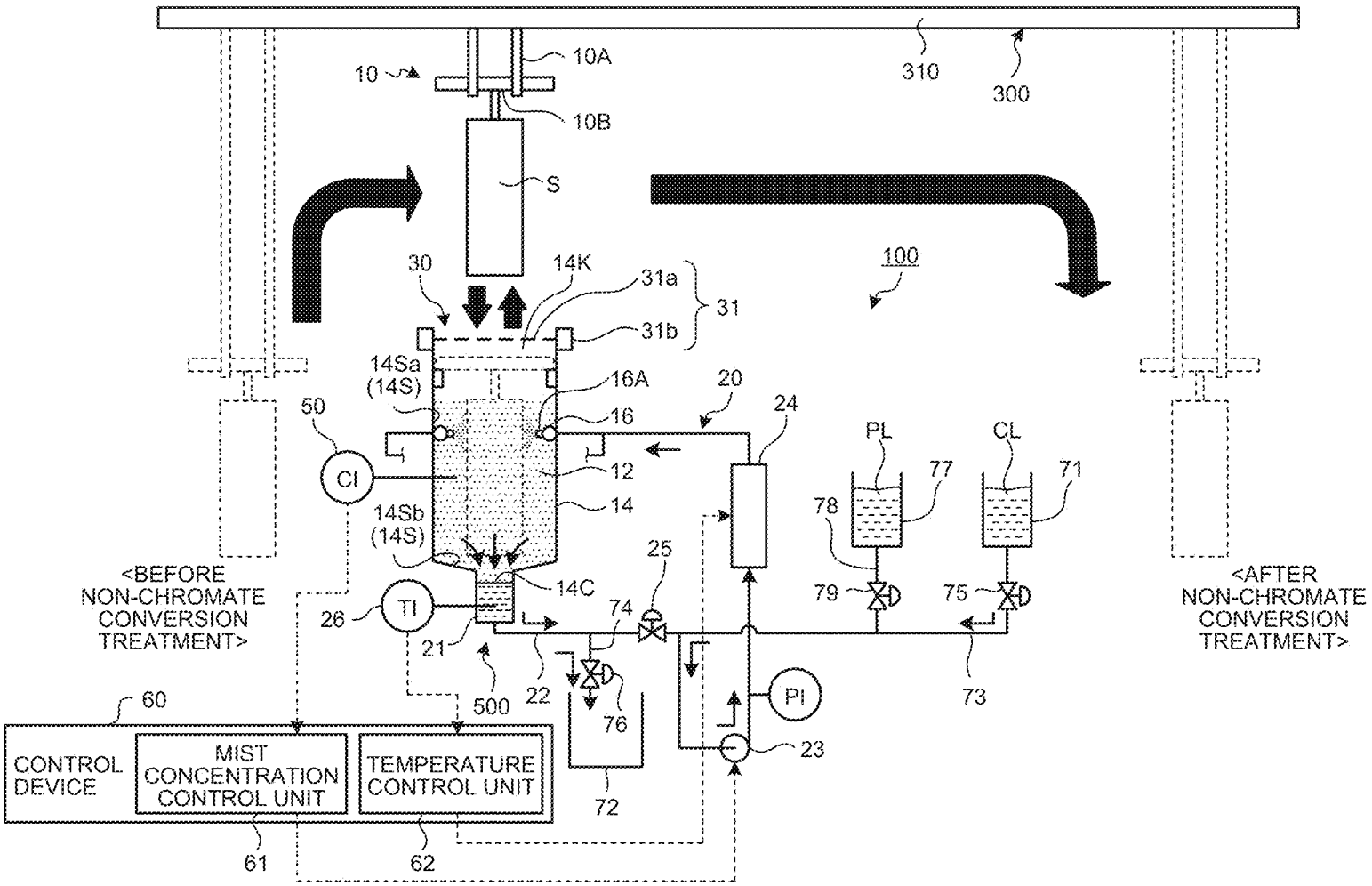
FIG. 3 is a schematic diagram illustrating a state in which a treatment liquid circulation system is cleaned with a cleaning device according to one embodiment.

FIG. 3 is a schematic diagram illustrating a state in which the treatment liquid circulation system 500 is cleaned by a cleaning device 70 according to the present embodiment. In the non-chromate conversion treatment, the non-chromate conversion treatment liquid PL circulates in the treatment liquid circulation system 500 and is brought into contact with the surfaces of the components of the treatment liquid circulation system 500. The surfaces of the components of the treatment liquid circulation system 500 that are in contact with the non-chromate conversion treatment liquid PL includes an inner surface of the inner flow channel of the spray nozzle 16, the inner surface 14S of the treatment vessel 14, an inner surface of the collecting pit 21, and an inner surface of the pipe 22.

The cleaning liquid supply device 71 supplies the cleaning liquid CL to the surfaces of the components of the treatment liquid circulation system 500 in the state in which the metal component S is not disposed in the treatment vessel 14, and cleans the components of the treatment liquid circulation system 500. The cleaning liquid CL that has been brought into contact with the surfaces of the components of the treatment liquid circulation system 500 and cleaned the components of the treatment liquid circulation system 500 is collected in the waste liquid recovery device 72 as a waste liquid together with the non-chromate conversion treatment liquid PL whose pot life has expired.

In the cleaning treatment using the cleaning liquid CL, the valve 25 provided to the pipe 22 is closed and the valve 75 provided to the pipe 73 and the valve 76 provided to the pipe 74 are opened.

The cleaning liquid CL sent out from the cleaning liquid supply device 71 flows in the pipe 73, then enters the pipe 22 and is supplied to the spray nozzle 16 through the pump 23. Thus, the inner surface of the pipe 22 and the inner surface of the inner flow channel of the spray nozzle 16 are cleaned with the cleaning liquid CL. The spray nozzle 16 supplies the cleaning liquid CL to the treatment space 12. The cleaning liquid CL supplied from the spray nozzle 16 to the treatment space 12 is in contact with the inner surface 14S of the treatment vessel 14. Thus, the inner surface 14S of the treatment vessel 14 is cleaned with the cleaning liquid CL. The cleaning liquid CL in the treatment space 12 is collected in the collecting pit 21 through the collecting port 14C and then flows in the pipe 22. Thus, the inner surface of the collecting pit 21 and the inner surface of the pipe 22 are cleaned with the cleaning liquid CL. The cleaning liquid CL in the pipe 22 is collected by the waste liquid recovery device 72 through the pipe 74.

[Treatment Liquid Exchanging Method]

In the case of supplying the non-chromate conversion treatment liquid PL newly after the cleaning, for example, the valve 79 is opened and the valve 25 and the valve 76 are closed. Thus, the new non-chromate conversion treatment liquid PL is supplied from the exchange treatment liquid supply device 77 to the pipe 22 through the pipes 78 and 73. After a necessary amount of new non-chromate conversion treatment liquid PL is supplied to the treatment liquid circulation system 500, the valve 25 is opened and the valve 79 is closed.

[Surface Treatment Method]

Figure 4:
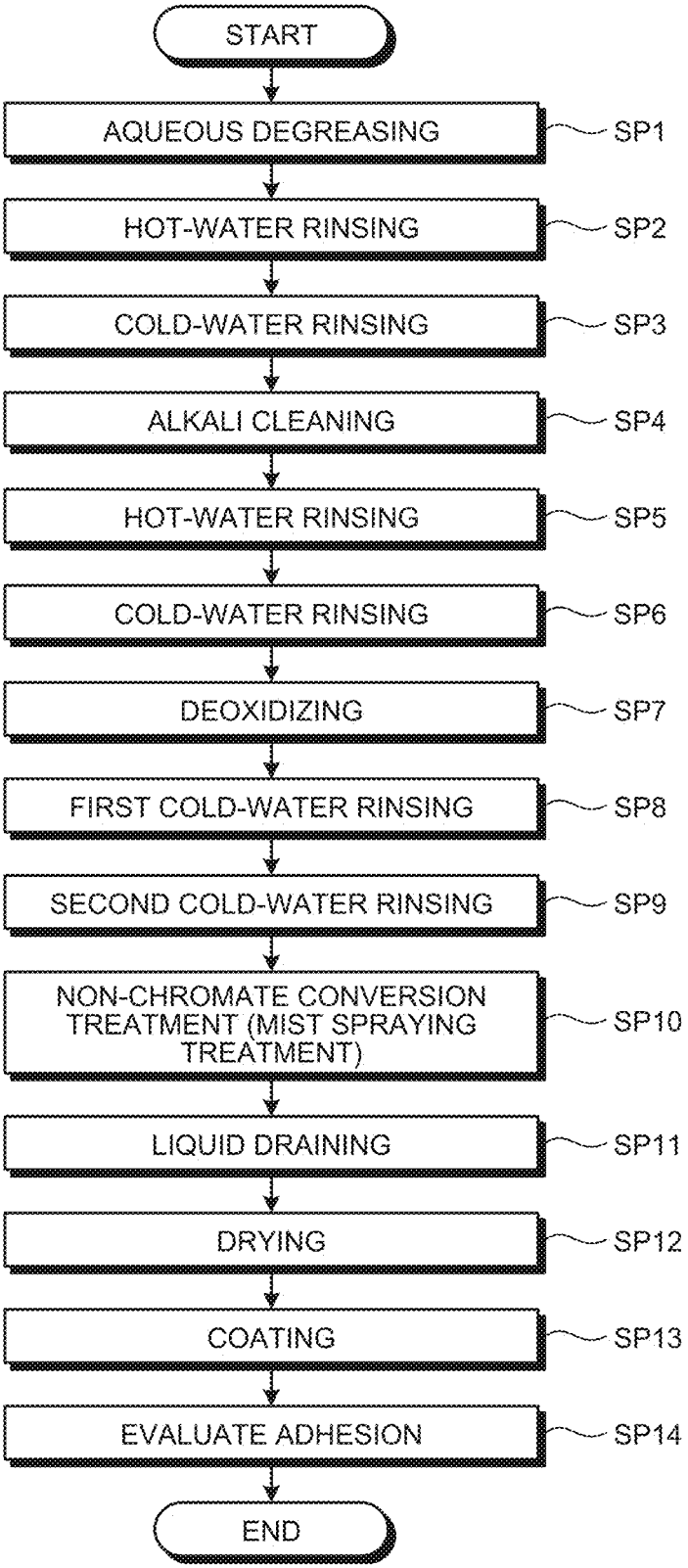
FIG. 4 is a flowchart of one example of a surface treatment method for a metal component according to one embodiment.
Figure 5:
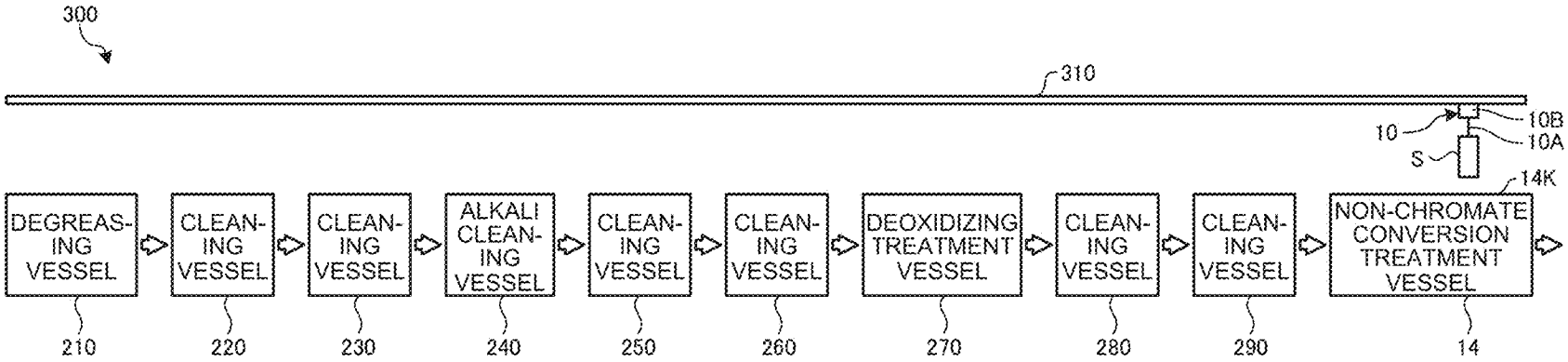
FIG. 5 is a schematic diagram illustrating one example of a surface treatment system including the surface treatment apparatus according to one embodiment.

Next, description is made of a surface treatment method for the metal component S according to the present embodiment. FIG. 4 is a flowchart of one example of the surface treatment method for the metal component S according to the present embodiment. FIG. 5 is a schematic diagram illustrating one example of a surface treatment system 1000 including the surface treatment apparatus 100 according to the present embodiment.

A degreasing treatment for the metal component S is performed (step SP1). In the present embodiment, this degreasing treatment is performed using an aqueous degreasing agent. The degreasing treatment is performed in a degreasing vessel 210. Through the degreasing treatment, the oil on the surfaces of the metal component S is removed.

The degreasing treatment is followed by a hot-water rinsing treatment for the metal component S (step SP2) and a cold-water rinsing treatment for the metal component S (step SP3). The hot-water rinsing treatment is performed in a cleaning vessel 220, and the cold-water rinsing treatment is performed in a cleaning vessel 230. Through the hot-water rinsing treatment and the cold-water rinsing treatment, the degreasing agent adhering to the surfaces of the metal component S in the degreasing treatment is removed.

Next, an alkali cleaning treatment for the metal component S is performed (step SP4). The metal component S is cleaned using an alkali solution. The alkali cleaning treatment is performed in an alkali cleaning vessel 240.

The alkali cleaning treatment is followed by a hot-water rinsing treatment for the metal component S (step SP5) and a cold-water rinsing treatment for the metal component S (step SP6). The hot-water rinsing treatment is performed in a cleaning vessel 250 and the cold-water rinsing treatment is performed in a cleaning vessel 260. Through the hot-water rinsing treatment and the cold-water rinsing treatment, the alkali solution adhering to the surfaces of the metal component S in the alkali cleaning treatment is removed.

Next, a deoxidizing treatment, which is a treatment for removing an oxide film on the metal component S, is performed (step SP7). The deoxidizing treatment is performed in a deoxidizing treatment vessel 270. In the present embodiment, the surface of the metal component S is subjected to the deoxidizing treatment using an aqueous treatment liquid with an acid or an oxidation-reduction agent, so that the oxide on the surfaces of the metal component S is removed.

The deoxidizing treatment is followed by a first cold-water rinsing treatment for the metal component S (step SP8) and a second cold-water rinsing treatment for the metal component S (step SP9). The first cold-water rinsing treatment is performed in a cleaning vessel 280, and the second cold-water rinsing treatment is performed in a cleaning vessel 290. Through the first cold-water rinsing treatment and the second cold-water rinsing treatment, the aqueous treatment liquid adhering to the surfaces of the metal component S in the deoxidizing treatment is removed.

Next, the non-chromate conversion treatment for the metal component S is performed (step SP10). The non-chromate conversion treatment is performed in the surface treatment apparatus 100 including the treatment vessel 14.

As illustrated in FIG. 5, the degreasing vessel 210, the cleaning vessel 220, the cleaning vessel 230, the alkali cleaning vessel 240, the cleaning vessel 250, the cleaning vessel 260, the deoxidizing treatment vessel 270, the cleaning vessel 280, the cleaning vessel 290, and the treatment vessel 14 are disposed in series in the present embodiment. The metal component S is sequentially conveyed into these vessels by the conveyance device 300, and subjected to an in-line treatment.

In the present embodiment, the conveyance device 300 includes a guide mechanism 310, and the holding mechanism 10 that can be moved as being guided by the guide mechanism 310. The support member 10B of the holding mechanism 10 is guided by the guide mechanism 310 and moved to these vessels.

The opening 14K is provided at the upper part of the treatment vessel 14. The conveyance device 300 conveys the metal component S, which has been subjected to the second cold-water rinsing treatment in the cleaning vessel 290, from the cleaning vessel 290 and conveys the metal component S into the treatment vessel 14. After moving the metal component S to the place above the treatment vessel 14, the conveyance device 300 lifts down the metal component S. Thus, the conveyance device 300 conveys the metal component S into the treatment space 12 in the treatment vessel 14 through the opening 14K.

After the metal component S is conveyed into the treatment space 12 in the treatment vessel 14, the opening/closing device 31 is closed.

After the metal component S is conveyed into the treatment space 12 and the opening/closing device 31 is closed, the control device 60 operates the pump 23 so that the mist of the non-chromate conversion treatment liquid PL is supplied from the spray nozzle 16 to the treatment space 12 in the treatment vessel 14 in which the metal component S is disposed.

The average droplet diameter of the mist is controlled to be as small as 70 [μm] or less. The mist of the non-chromate conversion treatment liquid PL, which is supplied from the spray nozzle 16 to the treatment space 12, does not drop suddenly or gather in one place in the space, and drifts slowly in the treatment space 12. Thus, the treatment space 12 is filled with the mist of the non-chromate conversion treatment liquid PL that is supplied from the spray nozzle 16.

In the present embodiment, the number of spray nozzles 16, the relative position thereof, and the direction of the injection orifice 16A are adjusted so as to make the treatment space 12 have sufficiently high and uniform mist concentration.

In the present embodiment, the distance between the spray nozzle 16 and the metal component S is adjusted so that the mist concentration in the treatment space 12 becomes sufficiently high and uniform. For example, if the distance between the spray nozzle 16 and the metal component S is too short, the mist adheres only to the surface of the metal component S that faces the spray nozzle 16, and less mist goes round to reach the back side of the metal component S that does not face the spray nozzle 16. In view of this, the distance between the spray nozzle 16 and the metal component S is adjusted so that the mist concentration in the treatment space 12 becomes uniform, that is, the mist goes round sufficiently to reach the back side of the metal component S that does not face the spray nozzle 16. In the present embodiment, the distance between the spray nozzle 16 and the metal component S in the X-axis direction is set to 150 [mm] or more.

The flow rate of the mist of the non-chromate conversion treatment liquid PL that is injected from the injection orifice 16A of the spray nozzle 16 and the amount of non-chromate conversion treatment liquid PL that is supplied from the spray nozzle 16 to the treatment space 12 per unit time can be regulated so that the mist concentration in the treatment space 12 becomes sufficiently high and uniform.

The mist of the non-chromate conversion treatment liquid PL that is supplied from the spray nozzle 16 diffuses not just to the surface of the metal component S that faces the spray nozzle 16 but also to the surface of the metal component S that does not face the spray nozzle 16 because the mist diffuses in the entire treatment space 12. The mist adheres uniformly to the surfaces of the metal component S regardless of the shape of the metal component S. If the metal components S exist in the treatment space 12, the mist adheres to the surfaces of those metal components S uniformly.

The mist concentration is detected by the detector 50. The control device 60 controls the pump 23 on the basis of the detection result from the detector 50 so that the mist concentration in the treatment space 12 becomes 100 [mL] or more and 5000 [mL] or less per cubic meter [$m^3$] of the treatment space 12, thereby regulating the flow velocity of and the amount of mist that is supplied from the spray nozzle 16.

Some of the mist of the non-chromate conversion treatment liquid PL that fills the treatment space 12 falls spontaneously by the action of gravity, and are thus collected to the collecting pit 21. The non-chromate conversion treatment liquid PL collected to the collecting pit 21 from the treatment space 12 flows in the pipe 22 of the circulation device 20 and is supplied to the spray nozzle 16 through the pump 23. The spray nozzle 16 supplies the non-chromate conversion treatment liquid PL, which has been collected to the collecting pit 21, to the treatment space 12.

Until a sufficient film of the non-chromate conversion treatment liquid PL is formed, the metal component S is left in the treatment space 12 filled with the mist. The control device 60 keeps supplying the mist of the non-chromate conversion treatment liquid PL from the spray nozzle 16 to the treatment space 12 in the treatment vessel 14 in which the metal component S is disposed until a sufficient film of the non-chromate conversion treatment liquid PL is formed on the surfaces of the metal component S. In addition, the control device 60 keeps supplying, to the spray nozzle 16, the non-chromate conversion treatment liquid PL that has been collected from the treatment space 12 using the circulation device 20. That is to say, the control device 60 keeps performing the mist spraying treatment: the mist of the non-chromate conversion treatment liquid PL is supplied from the spray nozzle 16 to the treatment space 12 in the treatment vessel 14 in which the metal component S is disposed while the non-chromate conversion treatment liquid PL is circulated in the treatment liquid circulation system 500 until a sufficient film of the non-chromate conversion treatment liquid PL is formed on the surfaces of the metal component S.

After a sufficient film of the non-chromate conversion treatment liquid PL is formed on the surfaces of the metal component S, the control device 60 stops the operation of the pump 23 to stop the injection of the mist from the spray nozzle 16. After the mist in the vessel falls, the opening/closing device 31 is opened. The metal component S on which a sufficient film of the non-chromate conversion treatment liquid PL is formed is conveyed out of the treatment space 12 by the conveyance device 300. The conveyance device 300 lifts up the metal component S and conveys the metal component S out of the treatment space 12 through the opening 14K.

The metal component S conveyed out of the treatment space 12 is subjected to a liquid draining treatment (step SP11) and a drying treatment (step SP12).

The metal component S, on which the film has been formed by the mist spraying treatment, is subjected to a coating treatment (step SP13). After a coating film is formed on the surfaces of the metal component S by the coating treatment, the adhesion between the metal component S and the coating film is evaluated (step SP14).

In addition, after the process in the surface treatment system 1000 ends or when the non-chromate conversion treatment liquid PL whose pot life has expired is exchanged with new non-chromate conversion treatment liquid PL, the treatment liquid circulation system 500 is cleaned using the cleaning device 70. After the cleaning treatment, the new non-chromate conversion treatment liquid PL is input to the treatment liquid circulation system 500.

[Operation and Advantageous Effects]

As described above, in the present embodiment, the treatment space 12 in the treatment vessel 14 is filled with the mist of the non-chromate conversion treatment liquid PL and the metal component S is disposed in the treatment space 12 filled with the mist; therefore, the mist drifting in the treatment space 12 sufficiently adheres to the surfaces of the metal component S. By making the non-chromate conversion treatment liquid PL into the mist, the non-chromate conversion treatment liquid PL can be applied sufficiently on the surfaces of the metal component S with various shapes regardless of the shape of the metal component S. In the case in which more than one metal components S are disposed in the treatment space 12, the non-chromate conversion treatment liquid PL is applied to the surfaces of the metal components S at the same time. After the non-chromate conversion treatment liquid PL in the treatment space 12 is collected, the collected liquid PL is supplied to the spray nozzle 16 by the circulation device 20. The spray nozzle 16 supplies the non-chromate conversion treatment liquid PL, which has been collected from the treatment space 12, again to the treatment space 12. Therefore, the metal component S can be subjected to the surface treatment with less non-chromate conversion treatment liquid PL (less non-chromate conversion treatment liquid PL held in the treatment liquid circulation system 500). In this manner, in the present embodiment, components having various shapes can be handled and more products can be produced with less non-chromate conversion treatment liquid PL, which is advantageous.

In the present embodiment, the spray nozzle 16 is a single-fluid spray nozzle. Therefore, the scattering and the vaporization of the mist of the non-chromate conversion treatment liquid PL into the treatment vessel 14 can be reduced and the loss of the non-chromate conversion treatment liquid PL circulating in the treatment liquid circulation system 500 can be reduced.

The average droplet diameter of the mist of the non-chromate conversion treatment liquid PL that is supplied from the spray nozzle 16 in the present embodiment is 70 [μm] or less, preferably 10 [μm] or more and 40 [μm] or less. Thus, the mist of the non-chromate conversion treatment liquid PL does not drop suddenly and can drift slowly in the treatment space 12, and therefore, can adhere sufficiently to the surfaces of the metal component S.

Figure 6:
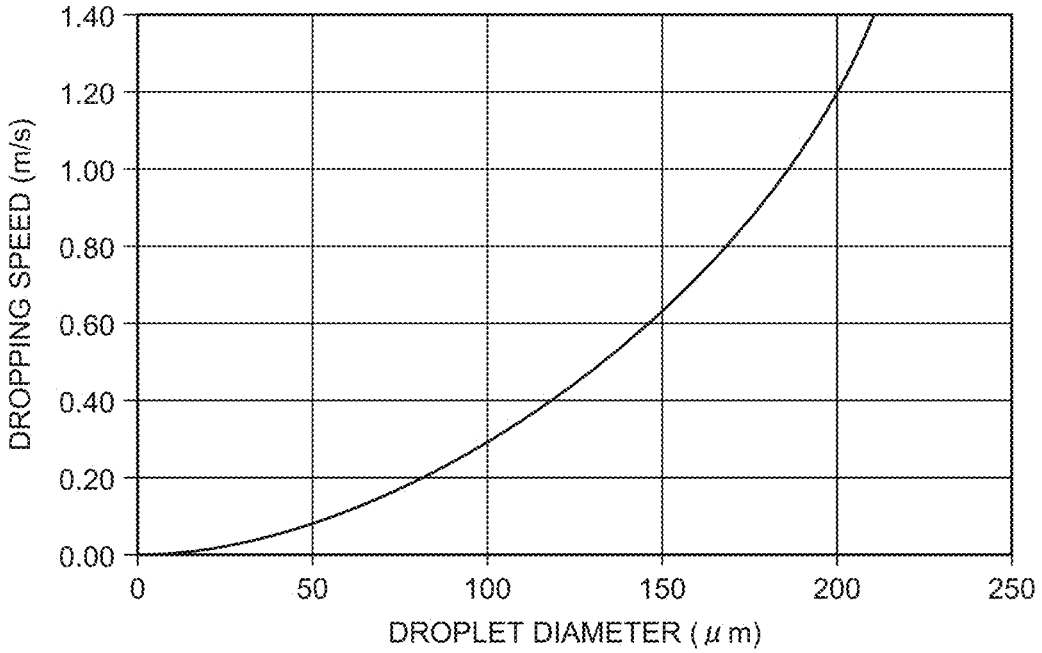
FIG. 6 is a diagram illustrating a relation between the droplet diameter of mist and the dropping speed of the mist.

FIG. 6 is a diagram illustrating a relation between the droplet diameter of the mist [μm] and the dropping speed [m/s] of the mist.

As illustrated in FIG. 6, the mist with smaller droplet diameter drops more slowly and requires longer time to drop in the treatment vessel 14. That is to say, the mist with smaller droplet diameter stays longer in the treatment space 12.

The present inventors have found out that the mist with an average droplet diameter of 70 [μm] or less can drift slowly in the treatment space 12 and can adhere to the surfaces of the metal component S sufficiently. According to the present embodiment, by setting the average droplet diameter of the mist to 70 [μm] or less, preferably 10 [μm] or more and 40 [μm] or less, the mist can stay longer in the treatment space 12 and the non-chromate conversion treatment liquid PL can sufficiently adhere to the surfaces of the metal component S.

In the spray mist treatment according to the present embodiment, the non-chromate conversion treatment liquid PL can sufficiently adhere to the surfaces of the metal component S even if the amount of non-chromate conversion treatment liquid PL that is held and circulates in the treatment liquid circulation system 500 is 10 [L] or less per cubic meter [$m^3$] of the treatment space 12. In the spray mist treatment according to the present embodiment, the amount of non-chromate conversion treatment liquid PL to be consumed is reduced to 1/100 or less of that in the immersion method, for example.

According to the present embodiment, the amount of non-chromate conversion treatment liquid PL to be supplied from the spray nozzle 16 to the treatment space 12 is 10 [L/min] or less per cubic meter [$m^3$] of the treatment space 12, preferably 0.5 [L/min] or more and 2.0 [L/min] or less per cubic meter [$m^3$] of the treatment space 12. Thus, a necessary and sufficient amount of mist can drift in the treatment space 12 while the consumption of non-chromate conversion treatment liquid PL is reduced.

According to the present embodiment, the mist concentration of the non-chromate conversion treatment liquid PL in the treatment space 12 is 100 [mL] or more and 5000 [mL] or less per cubic meter [$m^3$] of the treatment space 12. If the mist concentration is larger than 5000 [mL], the non-chromate conversion treatment liquid PL needs to be supplied more. Supplying the non-chromate conversion treatment liquid PL more causes the non-chromate conversion treatment liquid PL to be held more in the treatment liquid circulation system 500. If the mist concentration is less than 100 [mL], it is difficult to make the non-chromate conversion treatment liquid PL adhere to the surfaces of the metal component S sufficiently. By setting the mist concentration of the non-chromate conversion treatment liquid PL in the treatment space 12 is 100 [mL] or more and 5000 [mL] or less per cubic meter [$m^3$] of the treatment space 12, the non-chromate conversion treatment liquid PL can sufficiently adhere to the surfaces of the metal component S while the consumption of non-chromate conversion treatment liquid PL is reduced.

In the present embodiment, the circulation device 20 includes the temperature control device 24 that controls the temperature of the non-chromate conversion treatment liquid PL. By controlling the non-chromate conversion treatment liquid PL to have an optimal temperature with the temperature control device 24, the vaporization of the non-chromate conversion treatment liquid PL and the shortening of the pot life of the non-chromate conversion treatment liquid PL are suppressed and the change in property of the non-chromate conversion treatment liquid PL is suppressed.

In the present embodiment, the detector 50 is provided to detect the mist concentration of the non-chromate conversion treatment liquid PL in the treatment space 12. By the provision of the detector 50, whether the mist concentration in the treatment space 12 is normal can be monitored. If the detection result from the detector 50 indicates the mist concentration in the treatment space 12 is abnormal, the control device 60 can control the pump 23 to regulate the amount of non-chromate conversion treatment liquid PL that is supplied from the spray nozzle 16 so that the mist concentration in the treatment space 12 becomes normal. For example, if it is determined that the mist concentration in the treatment space 12 is lower than an allowable value, the control device 60 can control to supply more non-chromate conversion treatment liquid PL from the spray nozzle 16 to the treatment space 12.

According to the present embodiment, the suppressing device 30 is provided to suppress the scattering of the non-chromate conversion treatment liquid PL from the opening 14K provided at the upper part of the treatment vessel 14. Thus, the loss of the non-chromate conversion treatment liquid PL circulating in the treatment liquid circulation system 500 can be prevented.

According to the present embodiment, the suppressing device 30 includes the opening/closing device 31 that can open and close the opening 14K of the treatment vessel 14. Thus, by causing the opening/closing device 31 to switch the opening 14K from the closed state to the open state, the metal component S can be conveyed into and from the treatment space 12 easily. After the metal component S is conveyed into the treatment space 12, merely switching the opening 14K from the open state to the closed state by the opening/closing device 31 can prevent the loss of the non-chromate conversion treatment liquid PL circulating in the treatment liquid circulation system 500.

As described with reference to FIG. 5, in the present embodiment, the metal component S is sequentially conveyed into the vessels by the conveyance device 300 and subjected to the in-line treatment therein. Each vessel has an opening at its upper part, and through the opening, the conveyance device 300 can convey the metal component S into and from the vessel. Thus, the surface treatment for the metal component S can be efficiently performed.

In the present embodiment, the cleaning liquid supply device 71, which supplies the cleaning liquid CL to the surfaces of the components of the treatment liquid circulation system 500 that are in contact with the non-chromate conversion treatment liquid PL, and the waste liquid recovery device 72, which collects the waste liquid, are provided. Thus, in the case of exchanging the non-chromate conversion treatment liquid PL with the pot life, a new non-chromate conversion treatment liquid PL can be input to treatment liquid circulation system 500 after the used non-chromate conversion treatment liquid PL is sufficiently removed.

Figure 7:
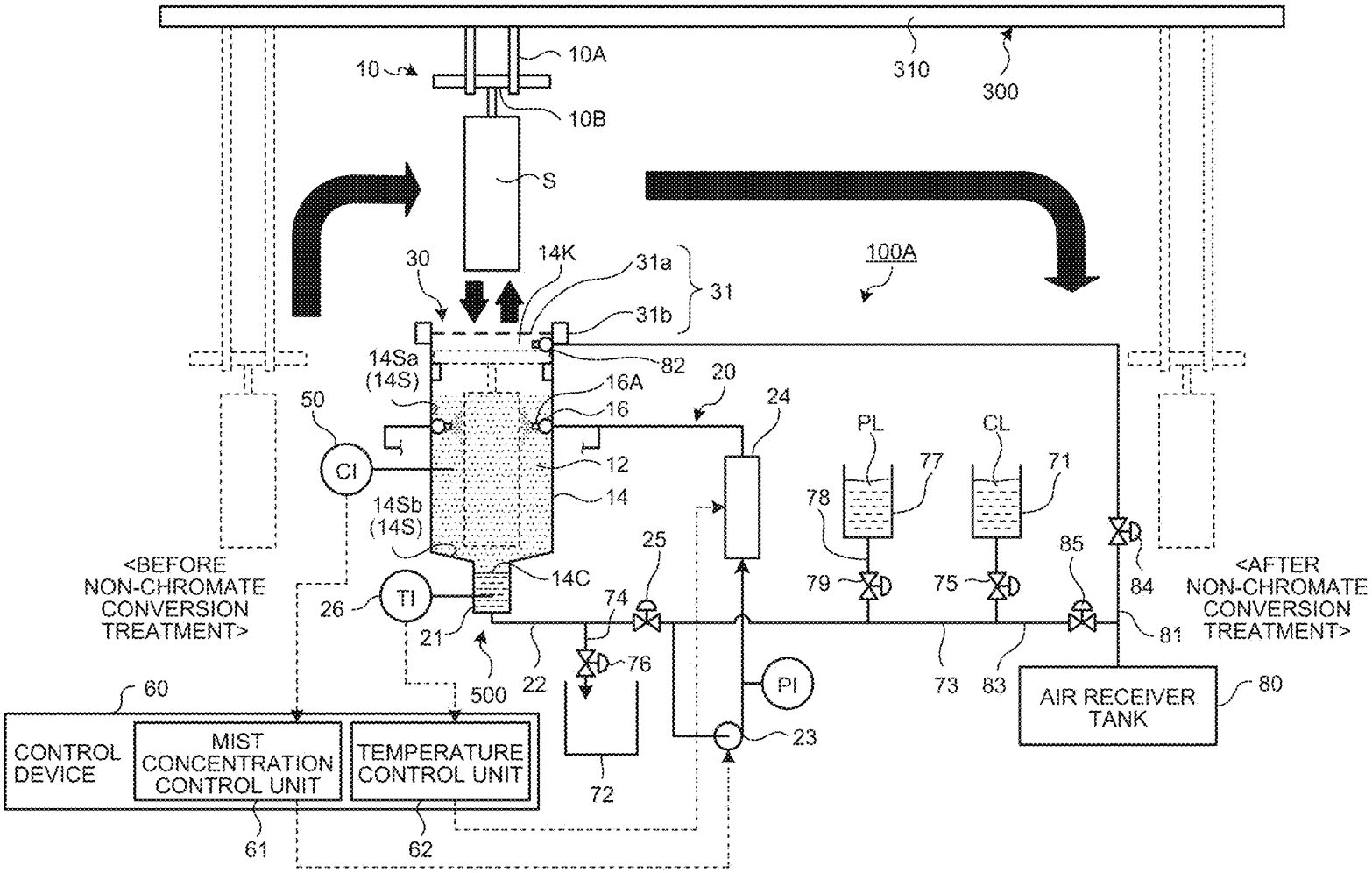
FIG. 7 is a schematic diagram of a surface treatment apparatus according to a modification.

In the above embodiment, air blow may be supplied to the treatment vessel 14 and the pipe 73. FIG. 7 is a schematic diagram of a surface treatment apparatus 100A according to a modification. As illustrated in FIG. 7, the surface treatment apparatus 100A includes an air receiver tank 80, a pipe 81, an air blow nozzle 82, a pipe 83, a valve 84, and a valve 85. The air receiver tank 80 is a supply source of the air blow. The pipe 81 is connected to the air blow nozzle 82. The air blow nozzle 82 is provided to the opening 14K of the treatment vessel 14. The air blow nozzle 82 can inject the air, which is supplied from the air receiver tank 80 through the pipe 81, to the treatment vessel 14 by opening the valve 84 provided to the pipe 81. The air blow nozzle 82 can form the air blow in the treatment vessel 14 by injecting the air when the metal component S is conveyed out, for example. Thus, the inside of the treatment vessel 14 can be cleaned quickly.

The pipe 83 is connected to the pipe 73. By opening the valve 85 provided to the pipe 83, the air is supplied form the air receiver tank 80 to the pipe 73 through the pipe 83. When the air is supplied to the pipe 73, the non-chromate conversion treatment liquid PL, the cleaning liquid CL, and the like in the pipe 73 flow to the pipe 22 side. In this manner, by the supply of purge air to the pipe 73, the pipe 22, and the pipe 83, the non-chromate conversion treatment liquid PL and the cleaning liquid CL can be prevented from being left in the pipe 73, the pipe 22, and the pipe 83.

Figure 8:
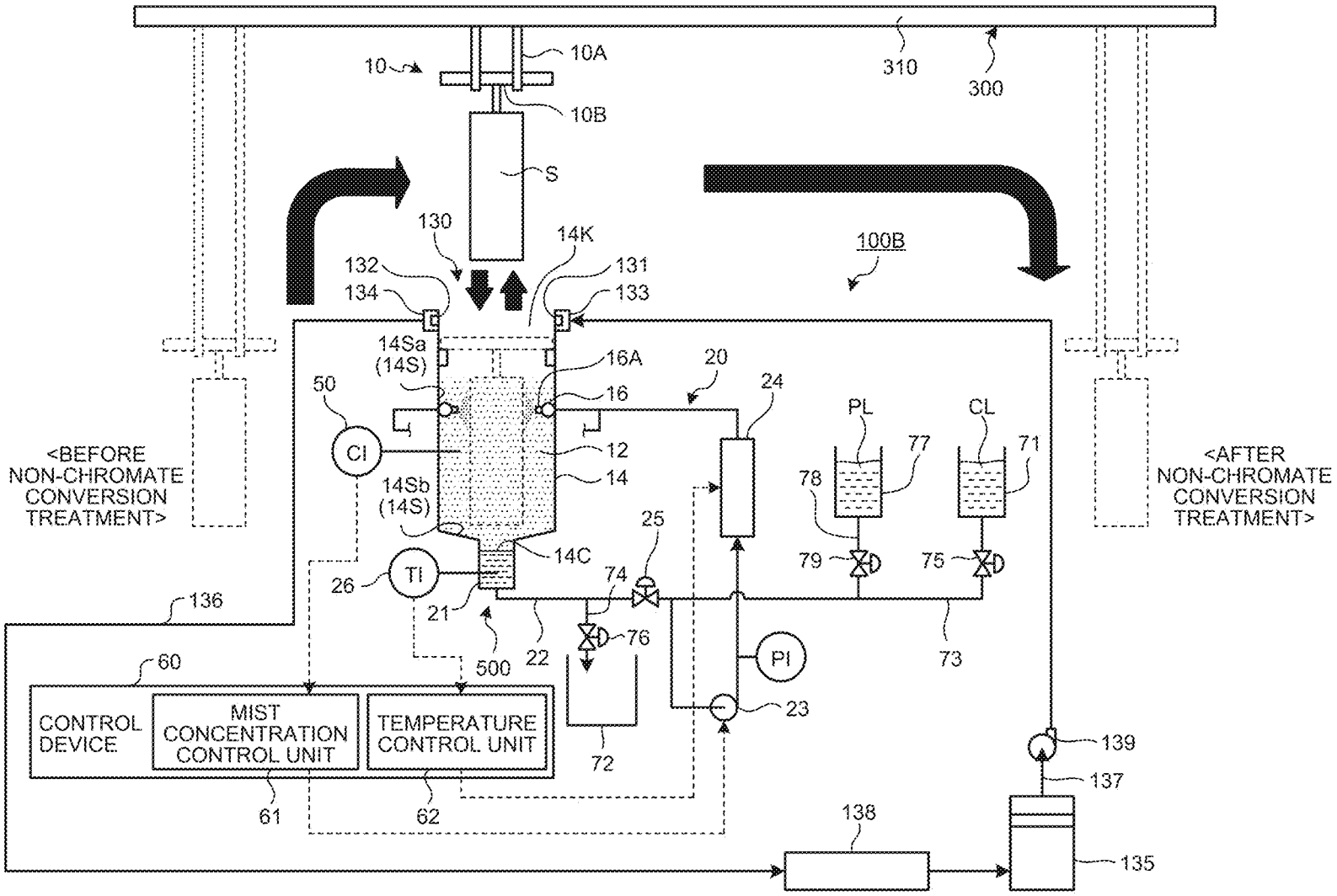
FIG. 8 is a schematic diagram of a surface treatment apparatus according to a modification.

In the aforementioned embodiment, the suppressing device 30 includes the opening/closing device 31; however, a gas curtain device may be included. FIG. 8 is a schematic diagram illustrating a surface treatment apparatus 100B according to a modification. As illustrated in FIG. 8, the surface treatment apparatus 100B includes a gas curtain device 130. The gas curtain device 130 includes a gas injection orifice 131 that injects the air to the opening 14K of the treatment vessel 14, a gas suction orifice 132 that sucks at least some of the air injected from the gas injection orifice 131, and a mist collector 135 that collects the non-chromate conversion treatment liquid PL sucked from the gas suction orifice 132. As the air is injected from the gas injection orifice 131, the air curtain is formed at the opening 14K.

At least some of the mist of the non-chromate conversion treatment liquid PL filling the treatment space 12 may be sucked from the gas suction orifice 132. The mist collector 135 collects the non-chromate conversion treatment liquid PL that is sucked from the gas suction orifice 132. The mist collector 135 is connected to a suction nozzle 134 through a pipe 136 and to an injection nozzle 133 through a pipe 137. The pipe 136 includes a temperature controller 138 that controls the temperature of the non-chromate conversion treatment liquid PL that is sucked from the gas suction orifice 132. The non-chromate conversion treatment liquid PL that is sucked from the gas suction orifice 132 is, after the temperature thereof is controlled by the temperature controller 138, collected by the mist collector 135 through the pipe 136.

The mist collector 135 has a gas-liquid separating function. The pipe 137 includes an air fan 139 that generates air to be injected from the gas injection orifice 131. As the air fan 139 operates, the air that is separated from the non-chromate conversion treatment liquid PL in the mist collector 135 is supplied to the injection nozzle 133 through the pipe 137. The injection nozzle 133 injects the air from the gas injection orifice 131 on the basis of the operation of the air fan 139.

In the present embodiment, the gas for forming the gas seal circulates in the injection nozzle 133, the suction nozzle 134, the pipe 136, the mist collector 135, the pipe 137, and the air fan 139. This flow channel includes an inner flow channel of the injection nozzle 133, an inner flow channel of the suction nozzle 134, a flow channel of the pipe 136, an inner space of the mist collector 135, a flow channel of the pipe 137, and an inner flow channel of the air fan 139. The non-chromate conversion treatment liquid PL included in the gas that flows in this flow channel is collected in the mist collector 135. The non-chromate conversion treatment liquid PL collected in the mist collector 135 is returned to the treatment liquid circulation system 500.

[Evaluation Test Result]

Example 1

Figure 9:
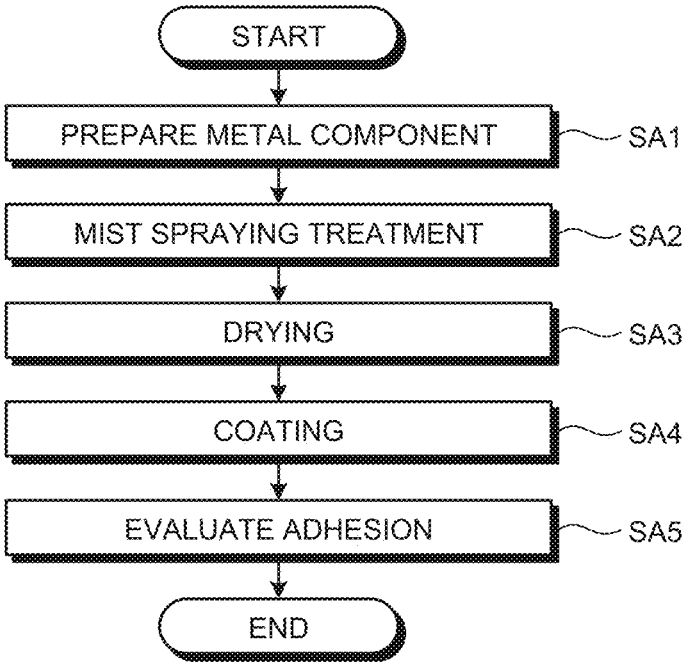
FIG. 9 is a flowchart of an evaluation test according to Example 1 of the present invention.

Next, description is made of an evaluation test result regarding the mist spraying treatment according to the present invention. FIG. 9 is a flowchart of the evaluation test according to Example 1 in the present invention. As illustrated in FIG. 9, the evaluation test according to Example 1 includes a step of preparing the metal component S (step SA1), a step of performing the mist spraying treatment according to the present invention on the metal component S (step SA2), a step of drying the metal component S having been subjected to the mist spraying treatment (step SA3), a step of coating the metal component S (step SA4), and a step of evaluating the adhesion between the metal component S and the coating film formed by the coating (step SA5).

(Step SA1: Preparation of Metal Component S)

A flat plate of aluminum alloy (2014-T3B) was prepared as the metal component S. The metal component S has a length of 256 [mm], a width of 76 [mm], and a thickness of 1 [mm]. This metal component S has been subjected to the alkali cleaning and the deoxidizing treatment in advance. In the alkali cleaning, "Super Bee 300LF" was used and in the deoxidizing treatment, "ALDOX V" was used.

(Step SA2: Mist Spraying Treatment)

By the mist spraying treatment according to the present invention, the non-chromate conversion treatment liquid PL was applied to the metal component S under the following condition:

(a1) Size of treatment vessel 14: 0.24 [$m^3$] (1000 [mm] in length, 600 [mm] in width, and 400 [mm] in height)

(b1) Non-chromate conversion treatment liquid PL: AC-131BB (3M)

(c1) Circulating amount (consumption) of non-chromate conversion treatment liquid PL: 1000 [mL]

(d1) Temperature of non-chromate conversion treatment liquid PL: 20 [° C.]

(e1) Type of suppressing device 30: lid member (1100 [mm] in length, 650 [mm] in width)

(f1) Spray nozzle 16: single-fluid spray nozzle (g1) Average droplet diameter of mist (Sauter mean diameter): 35 [μm]

(h1) Amount of non-chromate conversion treatment liquid PL that is supplied from the spray nozzle 16: 100 [mL/min]

(i1) Time for which the metal component S is placed in the treatment space 12 filled with the mist: 10 [minutes]

(j1) Mist concentration in the treatment space 12: 1.31

In regard to (c1), the treatment vessel 14 has a volume of 0.24 [$m^3$] and the flow channel of the treatment liquid circulation system 500 has a volume of about 0.25 [$m^3$]. Therefore, the circulating amount of non-chromate conversion treatment liquid PL that circulates in the flow channel of the treatment liquid circulation system 500 is about 4 [L] per cubic meter [$m^3$].

Figure 10:
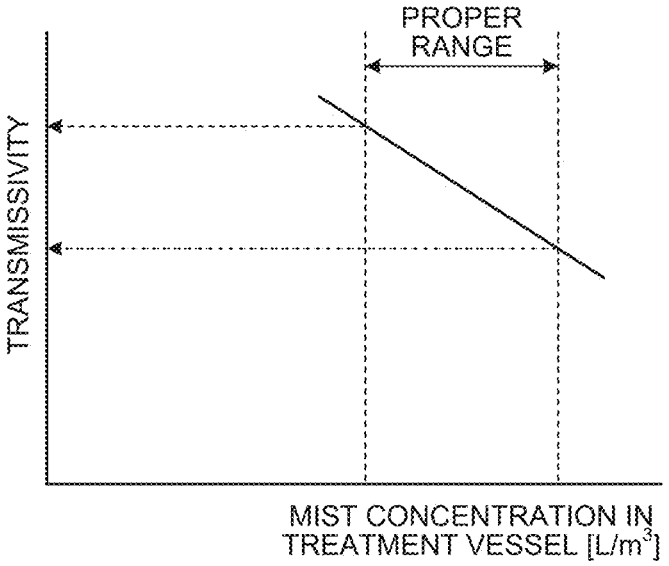
FIG. 10 is a diagram illustrating a relation between the amount of mist to be supplied and the transmissivity corresponding to a detection result from a detector.

In regard to (j1), the calculation was done based on the detection result from the detector 50 that is an absorptiometer. As the detector 50, MiniBSV (IRS) was used. FIG. 10 is a diagram schematically illustrating a relation between the mist concentration in the treatment vessel 14 and the transmissivity corresponding to the detection result from the detector 50. FIG. 10 illustrates the transmissivity in a case in which the mist concentration in the treatment vessel 14 is in a proper range.

(Step SA3: Drying)

The mist spraying treatment was followed by natural drying of the metal component S. The drying condition is as below.

(k1) Natural drying time: 24 [hours]

(l1) Natural drying temperature: room temperature (20 [° C.])

(Step SA4: Coating)

The natural drying was followed by coating the metal component S. The coating condition is as below.

(m1) Coating specification: epoxy primer (10P20-44) manufactured by AkzoNobel (n1) Coating method: air spraying (o1) Coating temperature: room temperature (20 [° C.])

(Step SA5: Evaluation on Adhesion)

The coating was followed by the evaluation on the adhesion between the metal component S and the coating film. The adhesion evaluation test is based on ASTM D3359 "standard test methods for rating adhesion by tape test". After the coated metal component S was immersed in water with a temperature of 20° C. for 168 [hours], the surface of the metal component S is cut in a grid form with a cutter. The crosscut width, which corresponds to the cutting intervals, is 1 [mm]. To a region that is cut, an adhesive tape (No. 250 tape of 3M) is attached and peeled off; then, the separation state of the coating film is evaluated. The adhesion is evaluated higher as the coating film is peeled off less. According to ASTM D3359, the separation state of the coating film is classified into six stages: "0B", "1B", "2B", "3B", "4B", and "5B". "5B" expresses the excellent adhesion, and the adhesion becomes lower as the numeral becomes smaller. "0B" expresses the worst adhesion. In Example 1, the coating film with the separation state expressed by "4B" or "5B" passes the test.

Table 1 lists the results of the adhesion evaluation test according to Example 1.

TABLE 1

[Example 1]

| Number of samples | Evaluation result | | | | |
|---|---|---|---|---|---|
| | 5B | 4B | 3B | 2B | 1B |
| 20 | 17 | 3 | 0 | 0 | 0 |

The evaluations were performed on 20 samples, and 17 of them were "5B", 3 of them were "4B", and none of them were "3B" or lower. These results indicate that, through the mist spraying treatment according to Example 1 of the present invention, the excellent adhesion between the metal component S and the coating film was achieved.

Example 2

Figure 11:
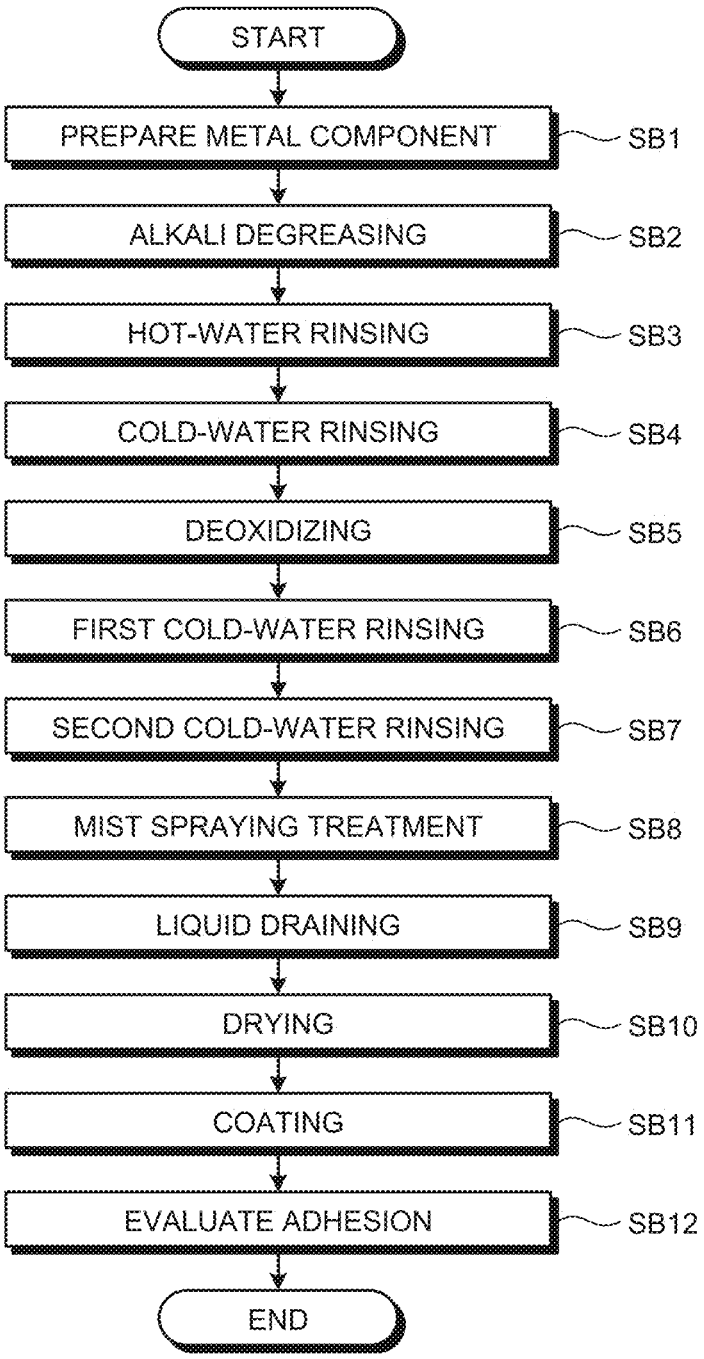
FIG. 11 is a flowchart of an evaluation test according to Example 2 of the present invention.

FIG. 11 is a flowchart of an evaluation test according to Example 2 in the present invention. As illustrated in FIG. 11, the evaluation test according to Example 2 includes a step of preparing the metal component S (step SB1), a step of performing an alkali degreasing treatment for removing oil from the metal component S (step SB2), a step of performing a hot-water rinsing treatment on the metal component S that has been alkali-degreased (step SB3), a step of performing a cold-water rinsing treatment on the metal component S (step SB4), a step of performing a deoxidizing treatment for removing an oxide film on the metal component S (step SB5), a step of performing a first cold-water rinsing treatment on the metal component S (step SB6), a step of performing a second cold-water rinsing treatment on the metal component S (step SB7), a step of performing the mist spraying treatment according to the present invention on the metal component S (step SB8), a step of performing liquid draining (step SB9), a step of dying the metal component S that has been subjected to the mist spraying treatment (step SB10), a step of coating the metal component S (step SB11), and a step of evaluating the adhesion between the coating film, which is formed by the coating, and the metal component S (step SB12).

In Example 2, the treatment from step SB1 to step SB10 is performed in the in-line treatment. That is to say, as described with reference to FIG. 5, the metal component S is sequentially disposed by the conveyance device 300 in the vessels in which the treatment is performed, and is subjected to the treatment therein. In the present embodiment, 50 metal components S are collectively conveyed and treated as a batch.

The second cold-water rinsing (step SB7) may be followed by the drying treatment for the metal component S and the dried metal component S may be manually conveyed into the treatment vessel 14 in which the spray mist treatment is performed.

The size and the material of the metal component S are similar to those in Example 1.

The alkali degreasing treatment (step SB2), the hot-water rinsing treatment (step SB3), the cold-water rinsing treatment (step SB4), the deoxidizing treatment (step SB5), the first cold-water rinsing treatment (step SB6), and the second cold-water rinsing treatment (step SB7) are performed under the following condition. The vessel used in each step has a size of 1.9 [$m^3$] (1700 [mm] in length, 800 [mm] in width, and 1400 [mm] in height).

(a2) Alkali degreasing treatment

Chemicals: Super Bee 300LF

Treatment temperature: 60 [° C.]

Treatment time: 10 [minutes]

(b2) Hot-water rinsing treatment

Cleaning temperature: 60 [° C.]

Cleaning time: 5 [minutes]

(c2) Cold-water rinsing treatment

Cleaning temperature: room temperature (20 [° C.])

Cleaning time: 1 [minute]

(d2) Deoxidizing treatment

Chemicals: ALDOX V

Treatment temperature: room temperature (20 [° C.])

Treatment time: 5 [minutes]

(e2) First cold-water rinsing treatment

Cleaning temperature: room temperature (20 [° C.])

Cleaning time: 5 [minutes]

(f2) Second cleaning treatment

Cleaning temperature: room temperature (20 [° C.])

Cleaning time: 5 [minutes]

The second cold-water rising treatment is followed by the mist spraying treatment according to the present invention (step SB8) and then, the non-chromate conversion treatment liquid PL is applied to the metal component S. The mist spraying treatment condition according to Example 2 is as below.

(g2) Size of treatment vessel 14: 1.9 [$m^3$] (1700 [mm] in length, 800 [mm] in width, and 1400 [mm] in height)

(h2) Non-chromate conversion treatment liquid PL: AC-131BB (3M)

(i2) Consumption (circulating amount) of non-chromate conversion treatment liquid PL: 6000 [mL]

(j2) Temperature of non-chromate conversion treatment liquid PL: room temperature (10 [° C.] or more and 35 [° C.] or less)

(k2) Type of suppressing device 30: lid member (1800 [mm] in length, 900 [mm] in width)

(l2) Spray nozzle 16: single-fluid spray nozzle (m2) Average droplet diameter of mist (Sauter mean diameter): 35 [μm]

(n2) Amount of non-chromate conversion treatment liquid PL that is supplied from the spray nozzle 16: 1000 [mL/min]

(o2) Treatment time for which the metal component S is placed in the treatment space 12 filled with the mist: 10 [minutes]

(p2) Amount of mist in the treatment space 12 (simulated value): 0.2 [kg/m$^3$]

(q2) Mist concentration in the treatment space 12 (absorptiometer coefficient): 1.31

After the mist spraying treatment, the liquid draining (step SB9) is performed. The liquid draining is performed at room temperature (20 [° C.]).

The drying treatment (step SB10), the coating treatment (step SB11), and the adhesion evaluation test (step SB12) according to Example 2 are performed under the condition similar to that of the drying treatment (step SA3), the coating treatment (step SA4), and the adhesion evaluation test (step SA5) according to Example 1.

Table 2 lists the adhesion evaluation test results according to Example 2.

TABLE 2

| [Example 2] | | | | | |
|---|---|---|---|---|---|
| Number of | Evaluation result | | | | |
| samples | 5B | 4B | 3B | 2B | 1B |
| 50 | 45 | 5 | 0 | 0 | 0 |

Fifty samples were evaluated, and 45 of them were "5B", 5 of them were "4B", and none of them were "3B" or lower. These results indicate that, through the mist spraying according to Example 2 of the present invention, the excellent adhesion between the metal component S and the coating film was achieved.

Comparative Example

In a comparative example, the non-chromate conversion treatment liquid PL was applied to the surfaces of the metal component S by the immersion method instead of the mist spraying treatment (step SA2) in Example 1. The size and the material of the metal component S are the same as those in Example 1. In Comparative example 1, the metal component S has been subjected to the alkali cleaning and the deoxidizing treatment in advance.

The non-chromate conversion treatment liquid PL is applied to the metal component S by the immersion method under the following condition.

(a3) Size of immersion vessel: 0.024 [m$^3$] (450 [mm] in length, 150 [mm] in width, and 350 [mm] in height)

(b3) Non-chromate conversion treatment liquid PL: AC-131BB (3M)

(c3) Consumption of non-chromate conversion treatment liquid PL: 24 [L]

(d3) Temperature of non-chromate conversion treatment liquid PL: 20 [° C.]

(e3) Immersion time: 10 [minutes]

After the non-chromate conversion treatment liquid PL was applied to the metal component S by the immersion method, the drying treatment, the coating treatment, and the adhesion evaluation test were performed. The drying treatment, the coating treatment, and the adhesion evaluation test were performed under the condition and in a manner that are similar to those of Example 1.

Table 3 lists the adhesion evaluation test result according to Comparative example.

TABLE 3

| [Comparative Example] | | | | | |
|---|---|---|---|---|---|
| Number of | Evaluation result | | | | |
| samples | 5B | 4B | 3B | 2B | 1B |
| 20 | 19 | 1 | 0 | 0 | 0 |

Twenty samples were evaluated, and 19 of them were "5B", 1 of them was "4B", and none of them were "3B" or lower. These results indicate that, through the mist spraying treatment according to Example 1 or 2 of the present invention, the adhesion as high as that by the immersion method, which is the conventional example, can be achieved.

OTHER EMBODIMENTS

In the above embodiment, the non-chromate conversion treatment liquid PL contains the silane coupling agent. As the non-chromate conversion treatment liquid PL that forms the organic film on the metal component S, a treatment liquid including at least one of chelate, aqueous resin, and conductive polymer films may be used.

As the non-chromate conversion treatment liquid PL, a treatment liquid that forms an organic-inorganic composite film on the metal component S may be used. Examples of the non-chromate conversion treatment liquid PL that forms the organic-inorganic composite film on the metal component S include a treatment liquid containing at least one of organic-inorganic composite silicate, a silicate compound, silica, organic-inorganic composite phosphate, metal acetylacetonate, and coating type non-chromium.

As the non-chromate conversion treatment liquid PL, a treatment liquid that forms an inorganic film on the metal component S may be used. As the non-chromate conversion treatment liquid PL that forms an inorganic film on the metal component S, a treatment liquid of at least one of Zr, Ti, Mo, W, Mn, Co, and Ce may be used.

REFERENCE SIGNS LIST

10 Holding mechanism
10A Suspension member
10B Support member
12 Treatment space
14 Treatment vessel
14C Collecting port
14K Opening
14S Inner surface
14Sa Inner side surface
14Sb Bottom surface
16 Spray nozzle
16A Injection orifice
20 Circulation device
21 Collecting pit
22 Pipe
23 Pump
24 Temperature control device
25 Valve
26 Thermometer
30 Suppressing device
31 Opening/closing device
31*a* Lid member
31*b* Switching mechanism
50 Detector

60 Control device
71 Cleaning liquid supply device
72 Waste liquid recovery device
73 Pipe
74 Pipe
75 Valve
76 Valve
77 Exchange treatment liquid supply device
78 Pipe
79 Valve
80 Air receiver tank
81 Pipe
82 Air blow nozzle
83 Pipe
84 Valve
85 Valve
100 Surface treatment apparatus
100A Surface treatment apparatus
100B Surface treatment apparatus
130 Gas curtain device
131 Gas injection orifice
132 Gas suction orifice
133 Injection nozzle
134 Suction nozzle
135 Mist collector
136 Pipe
137 Pipe
138 Temperature controller
139 Air fan
210 Degreasing vessel
220 Cleaning vessel
230 Cleaning vessel
240 Alkali cleaning vessel
250 Cleaning vessel
260 Cleaning vessel
270 Deoxidizing treatment vessel
280 Cleaning vessel
290 Cleaning vessel
300 Conveyance device
500 treatment liquid circulation system
1000 Surface treatment system
CL Cleaning liquid
PL Non-chromate conversion treatment liquid
S Metal component

The invention claimed is:

1. A surface treatment method performed in a surface treatment apparatus that includes a treatment vessel, a single-fluid spray nozzle, and a circulation device, the surface treatment method comprising:

performing a mist spraying treatment for supplying mist of a non-chromate conversion treatment liquid with an average droplet diameter of 70 micrometers [μm] or less from the single-fluid spray nozzle to a treatment space of the treatment vessel in which a metal component is disposed;

collecting, by the circulation device, the non-chromate conversion treatment liquid from the treatment space; and supplying, from the spray nozzle to the treatment space, the non-chromate conversion treatment liquid collected from the treatment space, wherein an amount of non-chromate conversion treatment liquid that is held and circulates in a treatment liquid circulation system is 10 liters [L] or less per cubic meter [$m^3$] of the treatment space, the treatment liquid circulation system including the spray nozzle, the treatment vessel, and the circulation device.

2. The surface treatment method according to claim 1, further comprising performing a degreasing treatment and an oxide film removing treatment for the metal component before the mist spraying treatment, wherein the metal component is sequentially conveyed by a conveyance device into a degreasing vessel in which the degreasing treatment is performed, a deoxidizing treatment vessel in which the oxide film removing treatment is performed, and the treatment vessel in which the mist spraying treatment is performed.

3. The surface treatment method according to claim 1, wherein an amount of non-chromate conversion treatment liquid to be supplied from the spray nozzle to the treatment space is 10 liters per minute [L/min] or less per cubic meter [$m^3$] of the treatment space.

4. The surface treatment method according to claim 1, wherein a mist concentration of the non-chromate conversion treatment liquid in the treatment space is 100 milliliters [mL] or more and 5000 milliliters [mL] or less per cubic meter [$m^3$] of the treatment space.

5. The surface treatment method according to claim 1, further comprising controlling, by a temperature control device, a temperature of the non-chromate conversion treatment liquid.

6. The surface treatment method according to claim 1, further comprising:

detecting, by a detector, a mist concentration of the non-chromate conversion treatment liquid in the treatment space; and controlling an amount of non-chromate conversion treatment liquid to be supplied from the spray nozzle based on a detection result from the detector.

7. A surface treatment method performed in a surface treatment apparatus that includes a treatment vessel, a single-fluid spray nozzle, and a circulation device, the surface treatment method comprising:

performing a mist spraying treatment for supplying mist of a non-chromate conversion treatment liquid with an average droplet diameter of 70 micrometers [μm] or less from the single-fluid spray nozzle to a treatment space of the treatment vessel in which a metal component is disposed;

collecting, by the circulation device, the non-chromate conversion treatment liquid from the treatment space; and supplying, from the spray nozzle to the treatment space, the non-chromate conversion treatment liquid collected from the treatment space, wherein an amount of non-chromate conversion treatment liquid to be supplied from the spray nozzle to the treatment space is 10 liters per minute [L/min] or less per cubic meter [$m^3$] of the treatment space.

8. A surface treatment method performed in a surface treatment apparatus that includes a treatment vessel, a single-fluid spray nozzle, and a circulation device, the surface treatment method comprising:

performing a mist spraying treatment for supplying mist of a non-chromate conversion treatment liquid with an average droplet diameter of 70 micrometers [μm] or less from the single-fluid spray nozzle to a treatment space of the treatment vessel in which a metal component is disposed;

collecting, by the circulation device, the non-chromate conversion treatment liquid from the treatment space; and supplying, from the spray nozzle to the treatment space, the non-chromate conversion treatment liquid collected from the treatment space, wherein a mist concentration of the non-chromate conversion treatment liquid in the treatment space is 100 milliliters [mL] or more and 5000 milliliters [mL] or less per cubic meter [$m^3$] of the treatment space.

* * * * *